United States Patent [19]

Barabas

[11] Patent Number: 4,586,962

[45] Date of Patent: May 6, 1986

[54] SURFACE CLEANING PROCESS

[75] Inventor: Eugene S. Barabas, Watchung, N.J.

[73] Assignee: GAF Corporation, Wayne, N.J.

[21] Appl. No.: 608,690

[22] Filed: May 10, 1984

Related U.S. Application Data

[63] Continuation-in-part of Ser. No. 538,954, Sep. 27, 1983, Pat. No. 4,521,253, and Ser. No. 454,127, Dec. 29, 1982, Pat. No. 4,451,296.

[51] Int. Cl.[4] ..... B08B 7/00

[52] U.S. Cl. ..... 134/4; 252/174.24; 252/DIG. 3

[58] Field of Search ..... 134/4; 252/174.24, 82, 252/542, DIG. 2, DIG. 3

[56] References Cited

U.S. PATENT DOCUMENTS

| | | | |
|---|---|---|---|
| 3,716,488 | 2/1973 | Kolsky et al. | 252/155 |
| 3,835,071 | 9/1974 | Allen et al. | 252/545 |
| 3,994,744 | 11/1976 | Anderle et al. | 134/4 |
| 4,200,671 | 4/1980 | Krajewski et al. | 134/4 X |
| 4,325,744 | 4/1982 | Panayappan et al. | 134/4 |

*Primary Examiner*—Marc L. Caroff

*Attorney, Agent, or Firm*—Joshua J. Ward; Marilyn J. Maue

[57] ABSTRACT

Particulate contaminant is removed from surfaces by applying a coating of an aqueous solution of copolymer of maleic acid and monomer. The particulate contaminant becomes incorporated into the coating during drying and the coating detaches itself from the surface without the necessity of peeling or otherwise mechanically removing the contaminant laden coating.

7 Claims, No Drawings

SURFACE CLEANING PROCESS

RELATED APPLICATION

This is a continuation-in-part of my applications Ser. No. 454,127, now Pat. No. 4,451,296 filed Dec. 29, 1982. Ser. No. 538,954, now Pat. No. 4,521,253, filed Sept. 27, 1983.

BACKGROUND OF THE INVENTION

Adequate removal of particulate contaminants from surfaces is in many instances a problem. This is especially true if the particulate contaminant is difficult to remove from the surface or if it is important to avoid residual contamination of the surrounding environment with the contaminant. Particularly difficult problems are encountered where it is desired to remove radioactive contaminants.

U.S. Pat. No. 4,424,079 and U.S. applications Ser. Nos. 454,127 and 538,954 describe processes for removing rust from rusty metal surfaces using copolymer of maleic acid with various monomers. It has now been found that a generally similar process is effective in removing particulate contaminant from surfaces contaminated with such contaminant by means other than chemical reaction between material of the surface and chemicals of the environment.

SUMMARY OF THE INVENTION

The process of the invention is a process for removing particulate contaminant from a surface contaminated with such contaminant by means other than chemical reaction between material of the surface and chemicals of the environment.

The process of the invention comprises:

(a) applying to such contaminated surface a layer of surface cleaning composition consisting essentially of an aqueous solution or dispersion of water soluble or water dispersible copolymer of maleic acid and unsaturated monomer; and (b) allowing said layer of cleaning composition to dry whereby particulate contaminant becomes incorporated into said layer and the layer containing the particulate contaminant detaches itself from the surface.

Suitable copolymers for use in practicing the invention include but are not limited to copolymers of maleic acid with one or more monomers of the formulas:

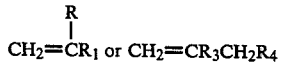

where

R is H, $CH_3$ or $C_2H_5$;

$R_1$ is H, $—CH_3$, $—COOR_2$, —CN, $—OCOR_2$, $—CON(R)_2$, $—CH=CH_2$, $—C_2H_5$,

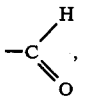

$—COR_3$, —SH, $—SO_3H$, —COOH, —Cl, —Br,

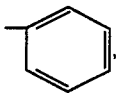

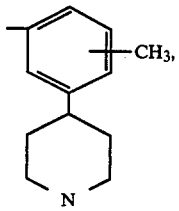

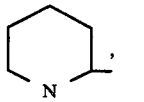

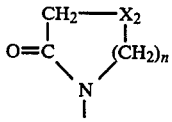

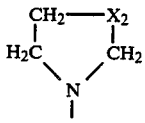

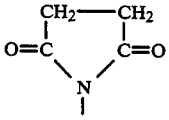

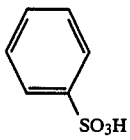

$R_2$ is $—CH_3$ or $—C_2H_5$;

$R_3$ is H, $—CH_3$ or

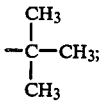

$R_4$ is $—OCOR_2$ or $—NHR_5$;

$R_5$ is H or $—CH—CH=CH_2$;

n is 1 to 4;

$X_1$ is $—CH_2$ or —O; and $X_2$ is —O or —NH

DETAILED DESCRIPTION OF THE INVENTION

Water soluble or water dispersible copolymers suitable for use in the process of the invention are copolymers of maleic acid with one or more unsaturated monomers. Such maleic acid copolymers may be formed by hydrolysis of precursor copolymers of maleic anhydride and one or more unsaturated monomers capable of forming water soluble or water dispersible copolymers of maleic acid. The presursor copolymer may be obtained by any of the conventional methods known for making such copolymers as exemplified for instance in U.S. Pat. Nos. 3,553,183 3,794,622, 3,933,763 and 4,424,079, the disclosures of which are incorporated herein by reference.

Suitable monomers for copolymerization with maleic anhydride precursor to form copolymers for use in the invention include for instance:

| | Formula | Name |
|---|---|---|
| 1. | $CH_2{=}CH_2$ | ethylene |
| 2. | $CH_2{=}CHCH_3$ | propylene |
| 3. | $CH_2{=}CH{-}CH{=}CH_2$ | butadiene |
| 4. | $CH_2{=}CHC_2H_5$ | butylene |
| 5. | $CH_2{=}CHCOOCH_3$ | methylacrylate |
| 6. | $CH_2{=}CHCOOC_2H_5$ | ethylacrylate |
| 7. | $CH_2{=}CHCOOC_2H_5N{<}^{CH_3}_{CH_3}$ | dimethylamino-ethylacrylate |
| 8. | $CH_2{=}CHCN$ | acrylonitrile |
| 9. | $CH_2{=}CHOCOCH_3$ | vinylacetate |
| 10. | $CH_2{=}CHOCOC_2H_5$ | vinylpropionate |
| 11. | $CH_2{=}CHCHO$ | acrolein |
| 12. | $CH_2{=}CHOCH_3$ | vinylmethylether |
| 13. | $CH_2{=}CHOC_2H_5$ | vinylethylether |
| 14. | $CH_2{=}CHOC_2H_5N{<}^{CH_3}_{CH_3}$ | dimethylamino-ethylvinylether |
| 15. | $CH_2{=}CHCONH_2$ | acrylamide |
| 16. | $CH_2{=}CHSCH_3$ | vinylmethylthioether |
| 17. | $CH_2{=}CHSC_2H_5$ | vinylethylthioether |
| 18. | $CH_2{=}CHNCO$ | vinylisocyanate |
| 19. | $CH_2{=}CHCOCH_3$ | vinylmethylketone |
| 20. | $CH_2{=}CHCOC(CH_3)_3$ | vinylisopropylketone |
| 21. | $CH_2{=}CHCl$ | vinyl chloride |
| 22. | $CH_2{=}CHBr$ | vinyl bromide |
| 23. | $CH_2{=}CHSO_3H$ | vinylsulfonic acid |
| 24. | $CH_2{=}CHSH$ | vinylsulfide |
| 25. | 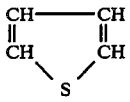 | vinylthiophene |
| 26. | 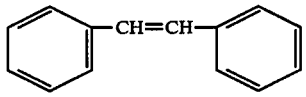 | stillbene |
| 27. | 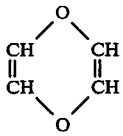 | dioxene |
| 28. | 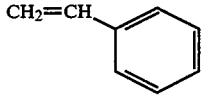 | styrene |
| 29. | 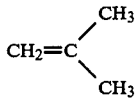 | isobutylene |

-continued

| | Formula | Name |
|---|---|---|
| 30. | 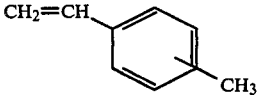 | vinyltoluene |
| 31. | 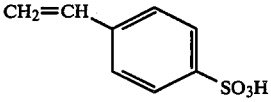 | vinylsulfonic acid |
| 32. | 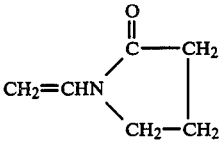 | vinylpyrrolidinone |
| 33. | 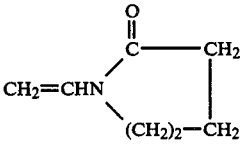 | vinylvalerolactam |
| 34. | 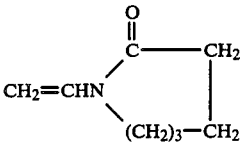 | vinylcaprolactam |
| 35. | 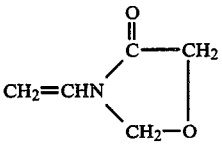 | vinyloxazolidinone |
| 36. | 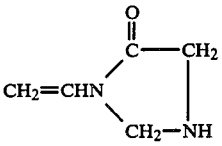 | vinylimidazolinone |
| 37. | 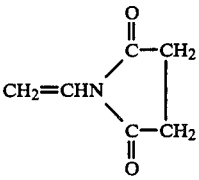 | vinylmaleiimide |
| 38. | 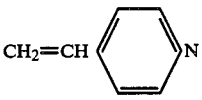 | 4-vinylpyridine |
| 39. | 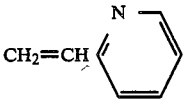 | 2-vinylpyridine |
| 40. | $CH_2{=}C(CH_3){-}COOH$ | methacrylic acid |
| 41. | $CH_2{=}CHCOOH$ | acrylic acid |
| 42. | $CH_2{=}C(CH_3){-}COOCH_2$ | methylmethacrylate |

-continued

| Formula | Name |
|---|---|
| 43. $CH_2{=}C(CH_3){-}COOC_2H_5$ | ethylmethacrylate |
| 44. $CH_2{=}C(CH_3){-}COOC_2H_5N(CH_3)_2$ | dimethylamino-ethylmethacrylate |
| 45. $CH_2{=}C(CH_3){-}CN$ | methacrylonitrile |
| 46. $CH_2{=}C(CH_3){-}OCOCH_3$ | methallylacetate |
| 47. $CH_2{=}C(CH_3){-}OCOC_2H_5$ | methallylpropionate |
| 48. $CH_2{=}C(CH_3){-}CHO$ | methacrolein |
| 49. $CH_2{=}C(CH_3){-}OCH_3$ | isopropenylmethylether |
| 50. $CH_2{=}C(CH_3){-}OC_2H_5$ | isopropenylethylether |
| 51. $CH_2{=}C(CH_3){-}OC_2H_5N(CH_3)_2$ | isopropenyldimethyl-aminoether |
| 52. $CH_2{=}C(CH_3){-}CONH_2$ | methacrylamide |
| 53. $CH_2{=}C(CH_3){-}SCH_3$ | isopropenylmethyl-thioether |
| 54. $CH_2{=}C(CH_3){-}SC_2H_5$ | isopropenylethylthio-ether |
| 55. $CH_2{=}C(CH_3){-}NCO$ | isopropenylisocyanate |
| 56. $CH_2{=}C(CH_3){-}COCH_3$ | isopropenyl methylketone |
| 57. $CH_2{=}C(CH_3){-}COC(CH_3)_3$ | isopropenyl-t-butyl-ketone |
| 58. 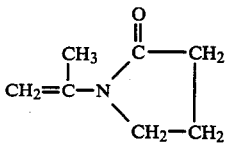 | isopropenylpyrroli-dinone |
| 59. 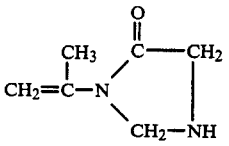 | isopropenylimi-dazolidinone |

-continued

| Formula | Name |
|---|---|
| 60. 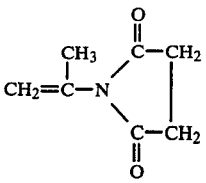 | isopropenyl-maleiimide |
| 61. 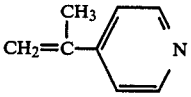 | 4-isopropenyl-pyridine |
| 62. 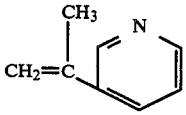 | 2-isopropenyl-pyridine |
| 63. $CH_2{=}CHCH_2OCOCH_3$ | allylacetate |
| 64. $CH_3CH{=}CHOCOC_2H_5$ | ethylcrotonate |
| 65. $CH_2{=}CHCH_2NH_2$ | allylamine |
| 66. $CH_2{=}C(CH_3){-}CH_2OCOCH_3$ | methallylacetate |
| 67. $CH_2{=}C(CH_3){-}CH_2NH_2$ | methallylamine |
| 68. 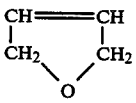 | 2,3 dihydrofurane |
| 69. 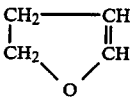 | 2,5 dihydrofurane |
| 70. 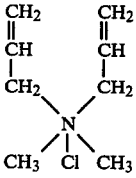 | dimethyldiallyl-ammonium chloride |

Precursors of copolymers for use in the process of the invention are maleic anhydride copolymers of the general formula

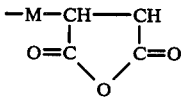

where M represents one or more monomers. As mentioned the copolymer is used in the form of an aqueous solution. The copolymer as used in the aqueous solution is hydrolyzed and has the general formula

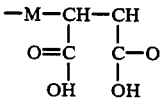

where M is as described above.

In practicing the invention the maleic acid is used in the form of an aqueous solution generally containing between about 5 and about 60 weight percent (wt %) copolymer and beteeen about 40 and about 90 wt % water. Such solutions may be formed in any suitable manner such as by mixing the copolymer or precursor copolymer with water by stirring or shaking at room temperature and may be used at varying degrees of neutralization such as in a pH range of about 1–7. Conventional organic or inorganic bases may be used to obtain the desired degree of neutralization. The molecular weight of the maleic acid copolymer used may vary widely. Copolymers having K values between about 20 and about 120 or even higher are for instance generally considered suitable for use in practicing the invention.

It will be appreciated that viscosities obtainable within the preferred limits of water content and K value mentioned above may vary widely, the major variable being the amount of water used. The choice of preferred viscosity for surface cleaning compositions for use in the invention will depend largely upon the intended use. For instance for lightly contaminated surfaces it may be desired to have a relatively thin liquid coating having a viscosity for instance between about 50 and about 50,000 centipoises (cps) such that the coating can be sprayed on or applied with an ordinary paint brush to a thickness between about 0.01 and about 5 mm. For many applications a relatively high viscosity, paste like coating having a viscosity e.g. between about 10,000 and about 250,000 cps may be desired. Such high viscosity coatings may be easily applied even to overhead surfaces, e.g. with a putty knife to form coatings of between about 0.5 and about 20 mm or thicker as desired. The paste like form of the copolymer is especially preferable for application to vertical or overhead surfaces where excessive dripping and flowing of the coating after it is applied to the rusted surface would be undesirable.

If desired the viscosity of coating composition for use in the invention may be increased by including in the composition one or more thickening agents in an amount sufficient to increase the viscosity of the composition to the desired value. For this purpose any conventional thickening agents may be used. When used, thickening agents are frequently used in amounts between about 0.1 and about 10 wt % based on total composition. Suitable thickening agents include for instance: natural or synthetic gums such as xanthan, guar, tragacanth, etc.; cellulose derivatives such as hydroxyethyl cellulose, etc. Cross-linked interpolymers of the type described in U.S. Pat. No. 3,448,088, are for instance suitable for this purpose.

In practicing the invention it is generally preferred that the coating composition be applied to the contaminated surface in a thickness of at least about 0.01 mm, more preferably between about 0.5 and about 20 mm. For heavily contaminated surfaces it is preferred that the coating be at least about 1 mm thick to ensure suitably complete removal of contaminant. Coatings applied in the preferred thicknesses mentioned will, under most normal conditions, dry in periods of time between about 0.5 and about 8 hours. Drying time depends upon a number of conditions including primarily coating thickness and viscosity and atmospheric conditions, especially temperature and humidity. If coatings are allowed to dry completely the contaminant particles become incorporated in the coating (assuming the coating is sufficiently thick for the amount of contaminant on the surface) and the dried coating containing the contaminant particles becomes detached from the surface in the form of flakes or small strips which may remove themselves from the surface or may be easily removed such as by brushing or blowing. In the case of overhead surfaces the self-removing feature is such that it is usually sufficient merely to allow the flakes or strips of dried coating to fall from the surface under the influence of gravity. The self-removing property of the copolymers used is relatively insensitive with respect to variations in temperature and humidity. Under some conditions, such as when the coating is not allowed to dry completely, it may be necessary to brush or scrape the surface to completely remove the contaminant laden coating.

The process of the invention may be used for removing particulate contaminant from the surfaces of a wide variety of materials including metal, plastics, glass, etc. Because of the self detaching feature of the process the surface does not even have to be smooth since scraping is not required for removal of contaminant laden coating. Particulate contaminant may for instance be removed from surfaces of glass, latex, gum, teflon, silicone, aluminum, brass, chromium, copper, gold, iron, lead, magnesium, nickel, silver, steel, stainless steel, tin, zinc, plaster, ceramic tile, quartz, mica, slate, glassine or waxed paper, high or low density polyethylene, polypropylene, cellulose acetate, rigid or plasticized vinyl, cellulose acetate butyrate, nylon, polymethylmethacrylate, polytetrafluoroethylene, polystyrene, polycarbonate, acrylonitrile butadiene-styrene, polyvinyl chloride, phenolformaldehyde, melamine-formaldehyde, alpha cellulose phenolformaldehyde, polyester, epoxy, silicone, epoxy terrazo, etc.

Contaminants removed by the process of the invention include any particulate contaminant not formed by chemical reaction between material of the surface and chemicals of the environment. Particle size of the contaminant may vary widely but is usually less than about 1 mm, especially if coating composition is applied in the preferred thicknesses mentioned above. Larger particles such as up to about 5 mm or even larger can be handled with thicker coatings but drying times will be increased. Contaminant may be in the form of loose particles lying on but not adhered to the contaminated surface or may be adhered to the surface by forces such as cohesion, coulombic forces, Van der Waals forces, etc.

The process of the present invention is especially useful where substantially complete removal of particulate contaminant is desired without leaving any residue in the air or on surrounding surfaces. The process of the invention may for instance be used to remove particulate contaminant which is either radioactive or contaminated with radioactive particles without leaving any residual radioactive contamination on the previously contaminated surfaces or in the environment surrounding the surfaces. Further, the tendency of the dried coating to be self removing in the form of flakes or strips rather than smaller particles facilitates complete removal of the dried coating containing the particulate contaminant without the residual contamination which might otherwise be present due to incomplete removal of small particles from the area.

The following examples are intended to illustrate the invention without limiting the scope thereof. The material identified in the examples as VAZO 52 is azobisdimethyl valeronitrile initiator available from duPont.

EXAMPLE

In order to demonstrate the usefulness of the process of the invention, various surfaces contaminated were treated in accordance with the invention. For each example finely divided particulate contaminant was dusted onto the surface of a sheet of material. A 50 mil thick film of a 35 percent aqueous solution of poly (vinylpyrrolidone-co-maleic anhydride) having a K value of 43 was then coated onto the thus contaminated surface. After standing overnight, the polymer film containing the contaminant particles embeddded therein separated easily from the surface in large flakes leaving a clean surface.

TABLE I

| Example No. | Surface | Contaminant |
|---|---|---|
| 1 | glass | activated charcoal |
| 2 | " | aluminum oxide |
| 3 | " | magnesium/aluminum silicate |
| 4 | " | silica |
| 5 | sheet aluminum | activated charcoal |
| 6 | poly (methyl-methacrylate) | " |
| 7 | poly (vinyl chloride) | " |
| 8 | glass reinforced polyester | " |
| 9 | poly (tetra-fluoroethylene) | " |

While the invention has been described above with respect to preferred embodiments thereof, it will be understood by those skilled in the art that various changes and modifications may be made without departing from the spirit or scope of the invention.

What is claimed is:

1. Process for removing particulate contaminant from a surface contaminated with such contaminant by means other than chemical reaction between material of the surface and chemicals of the environment, which process comprises:

(a) applying to such contaminated surface a layer of surface cleaning composition consisting essentially of an aqueous solution or dispersion of water soluble or water dispersible copolymer of maleic acid and vinylpyrrolidone monomer; and (b) allowing said layer of cleaning composition to dry whereby particulate contaminant becomes incorporated into said layer and the layer containing the particulate contaminant detaches itself from the surface.

2. Process according to claim 1 wherein the coating composition contains between about 5 and about 60 wt % copolymer and between about 40 and about 95 wt % water.

3. Process according to claim 1 wherein the coating composition has a viscosity between about 50 and about 250,000 cps.

4. Process according to claim 1 wherein the coating composition is applied to the surface in a layer between about 0.01 and about 20 mm thick.

5. Process according to claim 1 wherein the layer of applied coating composition is allowed to dry for between about 0.5 and about 8 hours.

6. Process according to claim 1 wherein:

(a) the coating composition contains between about 5 and about 60 wt % copolymer and between about 50 and about 95 wt % water;

(b) the coating composition has a viscosity between about 50 and about 250,000 cps;

(c) the coating composition is applied to the surface in a layer between about 0.01 and about 20 mm thick; and (d) the layer of applied coating composition is allowed to dry for between about 0.5 and about 8 hours.

7. Process according to claim 1 wherein the particulate contaminant includes radioactive particles.

* * * * *